United States Patent [19]

Tatsumi

[11] Patent Number: 4,890,530

[45] Date of Patent: Jan. 2, 1990

[54] STRINGED MUSICAL INSTRUMENT

[75] Inventor: Keizo Tatsumi, Hamamatsu, Japan

[73] Assignee: Yamaha Corporation, Hamamatsu, Japan

[21] Appl. No.: 269,597

[22] Filed: Nov. 10, 1988

[30] Foreign Application Priority Data

Nov. 12, 1987 [JP] Japan ..... 62-173589

[51] Int. Cl.[4] ..... G10D 1/08

[52] U.S. Cl. ..... 84/291

[58] Field of Search ..... 84/267, 291, 292, 327; D17/14–15, 18–20

[56] References Cited

U.S. PATENT DOCUMENTS

| | | | |
|---|---|---|---|
| D. 223,290 | 4/1972 | Wolfe | D17/14 |
| 1,304,914 | 5/1919 | Smith | 84/291 |
| 1,807,746 | 6/1931 | Moor | 84/291 X |
| 4,192,213 | 3/1980 | Steinberger | 84/293 |
| 4,242,938 | 1/1981 | Zalinge | 84/291 X |
| 4,317,402 | 3/1982 | McPherson | 84/291 |
| 4,715,259 | 12/1987 | Wittman | 84/327 |

FOREIGN PATENT DOCUMENTS

| | | | |
|---|---|---|---|
| 2312766 | 3/1973 | Fed. Rep. of Germany | 84/291 |

*Primary Examiner*—Lawrence R. Franklin

*Attorney, Agent, or Firm*—Burns, Doane, Swecker & Mathis

[57] ABSTRACT

A stringed musical instrument comprises a body portion having a front surface, a side surface and a concave back surface, a neck portion projecting from the side surface of the body portion and having a leading end, and a plurality of strings stretched over the front surface and the neck portion, so that a player's body is received into the concave, thereby supporting the musical instrument in a stable manner during a performance.

7 Claims, 3 Drawing Sheets

PRIOR-ART

STRINGED MUSICAL INSTRUMENT

FIELD OF THE INVENTION

This invention relates to a stringed musical instrument and, more particularly, to a body shape of a stringed musical instrument of the lute family.

BACKGROUND OF THE INVENTION

A modern lute type stringed musical instrument such as, for example, an electric guitar largely comprises a body plate, a neck projecting from the body plate and provided with a plurality of frets in spaced arrangement with one another, and a plurality of strings, typically six strings, each extending over the front surface of the body plate and terminating at the leading end of the neck. When playing the lute type stringed musical instrument, the musical instrument is held across the player's body and, then, the strings are plucked with the fingers of the right hand or a plectrum, the fingers of the left hand being used to force down the strings to one of the frets. Then, the body plate is usually brought into contact with the player's body at the back surface thereof during the performance.

A typical example of the electric guitar is illustrated in FIG. 1 of the drawings and largely comprises a body plate 1, a neck 2 projecting from the body plate 1, and a plurality of strings 3 stretched over the body plate 1 and the neck 2. The body plate 1 is formed of wood without a resonator and has a slightly curved front surface 4 and a flat back surface 5. On the front surface 4 of the body plate 1 is rockably supported a tremolo unit 6 which is coupled to the strings 3 for changing the respective vibration frequencies of the strings 3. A pick-up unit 7 is also provided on the front surface 4 of the body plate 1 in spaced relationship with the strings 3 so as to produce electric signals tantamount in waveform to the vibrations of the strings 3.

The neck 2 has a straight portion 8 and a head portion 9 bent with respect to the straight portion 8, and the leading end of the head portion 9 is projected over a virtual surface 10 coplanar to the back surface 5 of the body plate 1. Though not clearly shown in the drawings, the head portion 9 is provided with a plurality of pegs at which the strings are respectively terminated. On a front surface of a finger board 11 of the neck 2 are provided a plurality of frets 12 which are arranged in spaced relationship with one another in the longitudinal direction of the straight portion 8.

Prior to a performance, the electric guitar is coupled to an electric sound system (not shown) through wirings. Then, the player holds the electric guitar across his body and, then, plucks the strings while forcing down the strings on the frets.

However, a problem is encountered in the prior-art electric guitar in tuning errors due to deflection of the neck 2. This is because of the fact that the leading end of the head portion 9 projects over the virtual surface 10. Namely, when the electric guitar is placed on a flat surface, the back surface 5 is firstly brought into contact with the flat surface, but the electric guitar turns until the leading end of the head portion 9 comes into contact with the flat surface. This results in that the neck 2 is subjected to a bending moment due to the reaction force exerted on the leading end of the head portion 9. As a result, the neck 2 is slightly bent, and, accordingly, the distance between a nut 13 and a bridge 14 is slightly decreased.

Moreover, another problem is encountered in the prior-art electric guitar in instability with respect to the player's body during the performance. This is because of the fact that the back face 5 is flat. In general, a human body has a round shape something like a bulge, so that the body plate 1 is merely brought into contact with the human body at a small area. Then, the electric guitar is liable to move around the human body when the player slightly swings his body. This results in an unstable playing position.

SUMMARY OF THE INVENTION

It is therefore an important object of the present invention to provide a stringed musical instrument which is free from the tuning errors.

It is also an important object of the present invention to provide a stringed musical instrument which is capable of providing a stable playing position.

To accomplish these objects, the present invention proposes to form a concave back surface dictated to the round surface of the human body.

In accordance with the present invention, there is provided a stringed musical instrument having a front side, comprising: (a) a body portion having a front surface located on the front side, an end surface and a concave back surface; (b) a neck portion projecting from the end surface of the body portion and having a leading end; and (c) a plurality of strings stretched over the front surface and the neck portion.

In one implementation, the concave back surface may have a peripheral zone generally coplanar with a virtual surface, and the leading end of the head portion is located on the front side with respect to the virtual surface. In this implementation, it is preferable to select the weights of the body portion and the neck portion in such a manner that the center of gravity takes place in the body portion.

BRIEF DESCRIPTION OF THE DRAWINGS

The features and advantages of a stringed musical instrument according to the present invention will be more clearly understood from the following description taken in conjunction with the accompanying drawings in which.

DESCRIPTION OF THE PREFERRED EMBODIMENT

Figure 1:
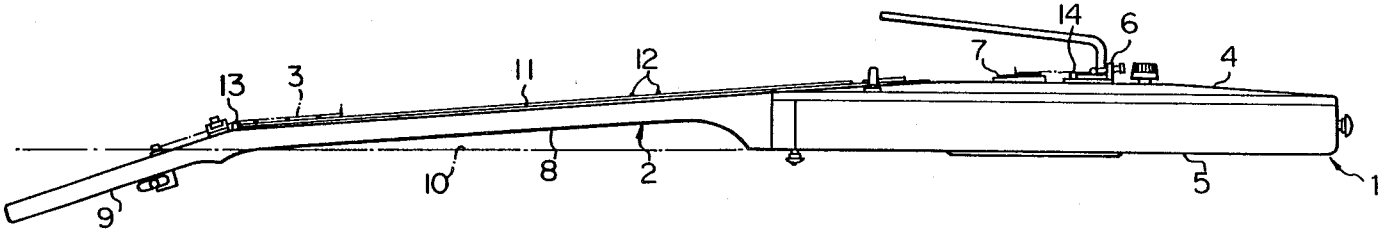
FIG. 1 is a front view showing the configuration of a prior art electric guitar.
Figure 2:
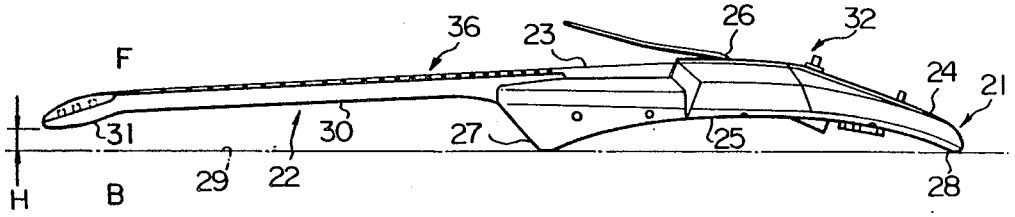
FIG. 2 is a front view showing the configuration of an electric guitar embodying the present invention.
Figure 3:
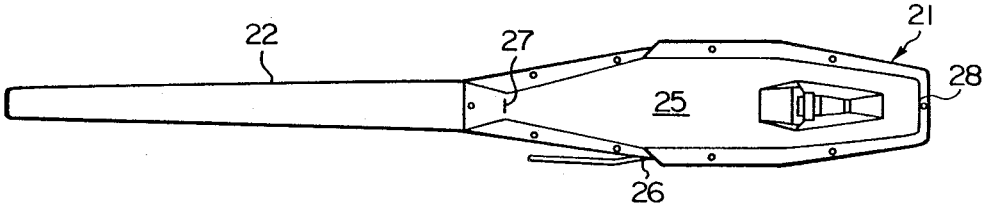
FIG. 3 is a bottom view showing the configuration of the electric guitar shown in FIG. 2.
Figure 4:
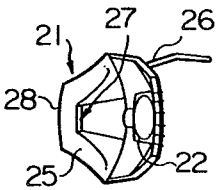
FIG. 4 is a side view of the electric guitar shown in FIG. 2.
Figure 5:
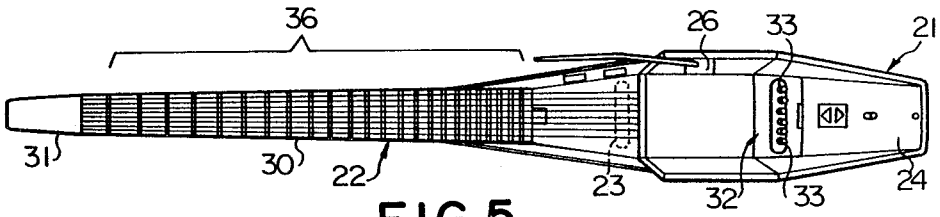
FIG. 5 is a top view showing the electric guitar shown in FIG. 2.
Figure 6:
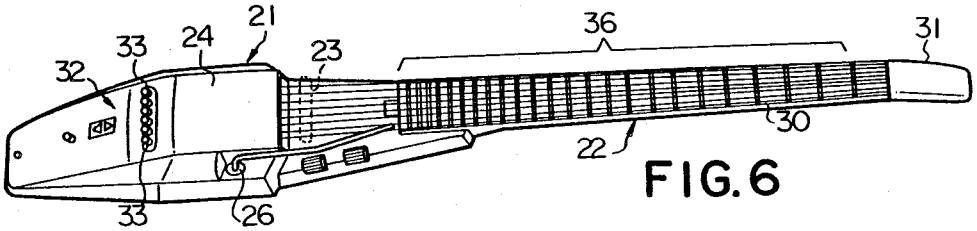
FIG. 6 is a perspective view of the electric guitar shown in FIG. 2.

Referring FIGS. 2 to 6, there is shown an electric guitar embodying the present invention. The electric guitar largely comprises a solid body portion 21, a neck portion 22, and a plurality of strings 23, typically six strings. The solid body portion 21 has a convex front surface 24 and a concave back surface 25. On the convex front surface 24 is rockably supported a tremlo unit 26 which is coupled to the strings 23 for changing the respective vibration frequencies of the strings 23 for applying the tremlo effect to the sound. Though not shown in the drawings, a pick-up unit is also provided on the front surface 24 of the solid body portion 21 in spaced relationship with the strings 23 so as to detect the vibrations of the strings 23 for producing electric signals tailored on the basis of the detected waveforms of the vibrations. On the concave back surface 25 of the solid body portion 21 are formed two ridges 27 and 28 which form part of a peripheral zone of the concave back surface 25. The two ridges 27 and 28 are located on a virtual surface which defines a front side F and a back side B. The concave back surface 25 is dictated to an external surface of a human body such as, for example, a belly or a thorax. Weights of the solid body portion 21 and the neck portion 22 are selected in such a manner that the center of gravity of the electric guitar takes place in the solid body portion 21.

The neck portion 22 has a straight portion 30 and a head portion 31 bent with respect to the straight portion 30, and the leading end of the head portion 9 is located on the front side F with respect to the virtual surface 29. A tuning unit 32 is provided on the front surface 24, and a plurality of pegs 33 are accommodated in the tuning unit 32. The strings 23 are respectively terminated at the tuning pegs 33, respectively, and the pegs 33 allow the player to change the tensions of the strings 23, respectively. On a front surface of a finger board of the neck 22 are provided a plurality of frets 36 which are arranged in spaced relationship with one another in the longitudinal direction of the straight portion 30.

As described hereinbefore, the ridges 27 and 28 are formed on the peripheral zone of the concave back surface 25, so that the leading end of the head portion 31 is located on the front side F with respect to the virtual surface 29 which is coplanar with the flat surface. Then, a gap H takes place between the flat surface and the leading end of the head portion 31, thereby preventing the neck portion from a bending moment. Subsequently, the electric guitar is coupled to an electric sound system (not shown) through wirings (not shown). Then, the player holds the electric guitar across his body and supports around his belly or thorax. In this situation, the player begins to pluck the strings 23 while forcing down the strings 23 on the frets 36 for producing sounds. During the performance, the player may swing his body, but the electric guitar hardly moves with respect to the player's body, because his body is received in the concave and brought into contact with the electric guitar at a relatively large area.

In the electric guitar hereinbefore described, the ridges 27 and 28 are fixedly formed on the back surface 25, however, the ridges 27 and 28 may be slidable with respect to the back surface in a longitudinal direction of the neck portion. Moreover, the ridges 27 and 28 are projectable from the back surface 25 so as to adjust the concave to the human body.

Although particular embodiment of the present invention have been shown and described, it will be obvious to those skilled in the art that various changes and modifications may be made without departing from the spirit and scope of the present invention. For example, the present invention is applicable to any musical instrument of the lute family such as an acoustic guitar, and the concave may be dictated to any portion of human body where the back surface is brought into contact.

What is claimed is:

1. A stringed musical instrument having a front side, comprising:
   (a) a body portion having a front surface located on said front side, an end surface and a concave back surface, said body portion being a solid body without resonator;
   (b) a neck portion projecting from the end surface of said body portion and having a leading end; and
   (c) a plurality of strings stretched over said front surface and said neck portion, in which said concave back surface has a peripheral zone generally coplanar with a virtual surface and in which said leading end is located on the front side with respect to said virtual surface.

2. A stringed musical instrument as set forth in claim 1, in which said body portion and said neck portion have respective weights selected in such a manner that the center of gravity of the musical instrument takes place in the body portion.

3. A stringed musical instrument as set forth in claim 2, in which said stringed musical instrument is an electric guitar.

4. A stringer musical instrument as set forth in claim 2, in which said concave is roughly dictated to an external surface of a human body.

5. A stringed musical instrument as set forth in claim 4, in which said human body is a belly.

6. A stringed musical instrument as set forth in claim 4, in which said human body is a thorax.

7. A stringed musical instrument as set forth in claim 4, in which said peripheral zone has ridges spaced apart from each other.

* * * * *